US006179608B1

(12) United States Patent
Kraemer et al.

(10) Patent No.: US 6,179,608 B1
(45) Date of Patent: Jan. 30, 2001

(54) SWIRLING FLASHBACK ARRESTOR

(75) Inventors: Gilbert O. Kraemer, New Haven; Jonathan Dwight Berry, Meriden, both of CT (US)

(73) Assignee: Precision Combustion, Inc., New Haven, CT (US)

( * ) Notice: Under 35 U.S.C. 154(b), the term of this patent shall be extended for 0 days.

(21) Appl. No.: 09/322,867

(22) Filed: May 28, 1999

(51) Int. Cl.[7] ..... F02G 3/00; F23D 3/40; F23D 14/14

(52) U.S. Cl. ..... 431/9; 431/8; 431/346; 239/552; 48/192

(58) Field of Search ..... 431/7, 170, 326, 431/328, 346, 350, 9, 182, 183, 185; 502/527.22, 527.18, 527.17, 527.12; 48/192; 60/723; 239/552

(56) References Cited

U.S. PATENT DOCUMENTS

| | | | | |
|---|---|---|---|---|
| 3,208,131 | * | 9/1965 | Ruff et al. . | |
| 5,162,288 | * | 11/1992 | Stringaro | 502/527 |
| 5,202,303 | * | 4/1993 | Retallick et al. | 431/7 |
| 5,228,847 | * | 7/1993 | Lywood et al. | 431/7 |
| 5,628,181 | * | 5/1997 | Kraemer | 431/346 |

FOREIGN PATENT DOCUMENTS

| | | | | |
|---|---|---|---|---|
| 4202018 | * | 4/1993 | (DE) | 431/7 |
| 0351082 | * | 1/1990 | (EP) | 431/346 |
| 0645527 | * | 3/1995 | (EP) | 431/7 |
| 26558 | * | 2/1924 | (FR) | 239/552 |
| 402118308 | * | 5/1990 | (JP) | 431/328 |
| 409243016 | * | 9/1997 | (JP) | 431/7 |
| 11-22925 | * | 1/1999 | (JP) | 431/7 |

OTHER PUBLICATIONS

"Gas Turbine Combustion", Arthur H. Lefebvre, Hemishere Publisheing Corp., pp. 122–137, 1983.*

* cited by examiner

*Primary Examiner*—Carl D Price
(74) *Attorney, Agent, or Firm*—McCormick, Paulding & Huber LLP

(57) ABSTRACT

A structure is disclosed that will quench a flame front during a flashback event in a gas turbine while simultaneously providing a mixing function during normal operations. The device disclosed consists of two monoliths one upstream of the other. In the basic embodiment of the invention the downstream monolith acts as a mixer while the combination of the upstream monolith and the downstream monolith act as the flashback arrestor. Other embodiments of the device also allow the downstream monolith to be a flameholder.

14 Claims, 5 Drawing Sheets

SWIRLING FLASHBACK ARRESTOR

BACKGROUND OF THE INVENTION

FIELD OF THE INVENTION

This invention relates to a structure for mixing a fuel and an oxidant Specifically, the invention is a swirler with an integral flashback arresting capability. In one application, the invention is positioned in a gas turbine combustor downstream of the fuel/air-mixing region and upstream of the primary combustion zone to assist in mixing the fuel and air while simultaneously providing protection from a flashback event. In another aspect of the invention, the invention can also have a flame holding capability.

BRIEF DESCRIPTION OF THE RELATED ART

Flashback within a gas turbine can be a catastrophic event A flashback event occurs when the flame front within the primary combustion zone of a gas turbine combustor moves upstream from the primary combustion zone toward the source of the fuel to an undesired degree. When such an event occurs, the heat of combustion within the flame front has the potential to damage numerous structures within the fuel/air-mixing region of the combustor. Flashback events are becoming increasingly common as gas turbine combustors are operated ever leaner to achieve environment pollution objectives.

Using close coupled, non-aligned, multi-channel monoliths to quench a flame front as it flashes back is known in the art. U.S. Pat. No. 5,628,181 is a prime example of this type of structure. The patent teaches that two close-coupled monoliths with channels of different cell sizes that do not impart any swirl to the flow stream can effectively quench a flame front. In one application of this invention, the monolith is placed in a gas turbine combustor between the fuel injection point and swirler, which is located downstream. When a flashback arrestor of the design of '181 is used, a downstream swirler is essential for combustion flame holding or premixing since the straight channels of the flashback arrestor have straightened the flow. Thus during a flashback event, the flame front will pass through the swirler before being arrested, thereby causing potential damage to the swirler, especially should flames be held off the swirl vane surfaces after the flashback event has been arrested.

For many gas turbine applications, therefore, it would be beneficial if the swirler could be protected from a flashback event. If a swirl component could be integrated into the flashback arrestor, this would permit premixing, and under specific conditions enhancement of downstream flame holding, without a separate downstream device. Further since there would no longer be a swirler downstream of the flashback arrestor, a flashback event would no longer be catastrophic to the swirler.

SUMMARY OF THE INVENTION

It has now been found that a swirl velocity component can be added to the conventional flashback arrestor thereby creating an integral swirler flashback arrestor.

The basic invention is comprised of two multiple channel monoliths, one spatially upstream in a fluid flow from the other. Upstream is defined in relationship to the normal or desired flow direction. In a gas turbine combustor application which is one application for the present invention, the invention is placed between the fuel source and the primary combustion zone, thus the desired flow direction is then defined as the direction of flow of the fuel from the fuel's source to the primary combustion zone. The direction of flow in a flashback event, from the primary combustion zone to the fuel source, is considered abnormal and/or undesired.

The two monoliths are placed across the fluid flow, such that substantially all the fluid must go through the invention. In a gas turbine application, this means placing the two monoliths within a conduit, such that bypass is in essence eliminated. If excess bypass is present the device will not function properly, since unarrested flames could bypass the device resulting in damage to the engine.

The monoliths contain numerous channels with each channel being defined by walls having a length, a mean hydraulic diameter, and a spatial orientation. The channels of the two monoliths are offset. Offset means that the channels in the downstream monolith are aligned with the channels in the upstream monolith such that a flame front exiting a downstream monolith channel intercepts the wall of an upstream monolith channel. While it is not required that every downstream monolith channel be offset from an upstream monolith channel, the required number being application dependent, generally substantially all the channels must be offset, and it is preferred that all channels be offset.

The mean hydraulic diameters of the channels in both the upstream and downstream monolith are application dependent, considering the fuel, the fuel/air ratio, and the channel length. In general, the mean hydraulic diameters of the channels can always be less than the critical quenching diameter. The offsetting of the channels, however, permits the channel mean hydraulic diameters in either or both monoliths to exceed the critical quenching diameter. This feature of the invention permits the pressure drop of the invention to be reduced without effecting the invention's ability to arrest a flashback event. Testing with hydrogen indicates that under one set of conditions flashback was successfully arrested when the downstream monolith channels had a mean hydraulic diameter of approximately twice the critical quenching diameter and the upstream monolith had channels with a mean hydraulic diameter of approximately four times the critical quenching diameter. For each application, therefore, the operational range of mean hydraulic diameter ratios must be determined.

A gap between the monoliths is not preferred, but can be present. The length of any gap is application dependent. The gap must be less than the flame reformation distance. This distance is defined as the distance required for the flame front to reform into a flame front that can not be quenched by the upstream monolith. Incidental flame front reformation, therefore, may take place in the gap. A practical limit on the gap seems to be the largest channel mean hydraulic diameter found in the channels of the invention.

In the preferred embodiment of the invention, the channels the downstream monolith have smaller mean hydraulic diameters than the channels in the upstream monolith. While the invention will still prevent flashback if this condition is reversed, the invention is less effective, and may even permit a flame to be held by the downstream monolith. For example during two tests at the same conditions employing non-swirling hexagonal cell monoliths, one monolith with 0.108 inch mean hydraulic diameter channels and a second monolith with 0.054 inch mean hydraulic diameter channels, flame holding after a flashback event was observed when the 0.108 inch mean hydraulic diameter channel monolith was downstream of the 0.054 inch mean hydraulic diameter channel monolith damaging the monoliths, but no flame holding damage was observed when the monoliths were reversed.

The channels of the monoliths are given a spatial orientation so that the channels act as vanes to alter the direction of the entering flow field. An alteration in the flow field to add a swirl component is most beneficial. Any type of swirl is possible such as axial, radial, or axial/radial. The downstream flow field can be distributed or have vortex break down. The invention must generate a swirl with a swirl number greater than zero. A swirl number greater than 0.1 is desired with the preferred range of 0.2 to 0.6 for premixing and 0.5 to 1.8 for flame stabilization, the range of current swirlers. See Arthur H. Lefebvre, *Gas Turbine Combustion* 126–135 (1983), incorporated herein by reference, for the definition of swirler number and the characteristics of swirling flows.

Various vane strategies are possible. A basic embodiment of the invention uses the channels of the upstream monolith to straighten the flow or partially turn the flow, and the channels of the downstream monolith as vanes to introduce a swirl. It is, however, possible to have the upstream monolith channels act as the vanes and then have the channels of the downstream monolith be straight, but oriented relative to the channels of the upstream monolith such that the swirl component added to the fluid flow in the upstream monolith is retained as the fluid passes through the second monolith.

In other versions of the invention, the channels of the upstream monolith and the channels of the downstream monolith could be spatially oriented to be corotating or contrarotating, but random, if desired for an application, is possible. A corotating relationship might aid in pressure loss reduction. For example in the case where a θ of 45 degrees is desired, the static pressure loss can be reduced by about 40% by using an upstream monolith with a θ of 20 degrees and a downstream monolith with a θ of 45 degrees as compared to the case where the upstream monolith has a θ of 45 degrees. See Arthur H. Lefebvre, *Gas Turbine Combustion* 126–135 (1983), incorporated herein by reference, for discussion of the geometry of channels in a swirler.

The relative arrangement of the channels within the monolith is not critical. Simple channel configurations are concentric or spiral about a center.

A channel can either be flat blade or curved blade. In addition, entrance and exit mean hydraulic diameters can be different, cross sectional geometry can vary, and the cross-sectional area of a channel can be constant or changing. The precise geometry of the channels is a function of such factors as the relevant fluids utilized in combustion, the critical quenching diameter of the relevant fluids and channel geometry, and the velocity and turbulence intensity of the flow through the invention. Relative to each other, however, it is preferred that the downstream monolith has channels smaller in cross-section than those of the upstream monolith. Some tests have demonstrated diminished flashback arresting ability for arrangements with the larger channel monolith downstream. Reduced costs and pressure loss may be realized if larger channel size is downstream especially for designs using non-swirling upstream monoliths.

The walls of the channels have quenching surfaces. A quenching surface is defined as any surface for the application which extracts heat or reduces the net chemical reaction rate or both from a fluid in contact with it during a flashback event, such that the fluid becomes less susceptible to burning due to the loss of thermal or chemical energy or both. Conversely, a non-quenching surface is a surface that either adds or does not increase the energy during a flashback event. Under certain conditions, an oxidation catalyst deposited on a wall surface could result in the surface being a non-quenching surface during a flashback event.

A hub feature can be incorporated into either monolith. If a hub feature is incorporated in one monolith it will most likely be incorporated into the other. The hub could be a solid body or some other structure dictated by the application, such as a fuel injector. If a solid body is used, the body could be designed to assist in the creation of a recirculation zone or mixing.

This invention in addition to being a mixer can also be a flame stabilizer. To be a flame stabilizer the swirl upon departing the downstream monolith should form a recirculation zone. A recirculation zone will form when the vortex being created breaks down. Specific requirements for θ can be calculated by those skilled in the art. Generally, to have a recirculation zone, the swirl number must be greater than 0.5.

The invention can further incorporate a flow conditioner. A flow conditioner, a third monolith, can be added upstream of the swirler flashback arrestor unit, with a gap existing between the conditioner and the arrestor unit. The conditioner has the function of organizing the flow field into the arrestor to reduce or eliminate random fluid flow vectors in the flow stream within the distance of the gap. Flashback is more difficult to arrest in highly skewed flows due to local low-flow velocity regions. Flashback becomes more difficult to arrest as the local channel velocity approaches the laminar flame speed. To maximize performance of the arrestor, the channels in the conditioner are oriented to complement the orientation of the channels in the most upstream monolith of the arrestor.

DETAILED DESCRIPTION OF THE PREFERRED EMBODIMENTS OF THE INVENTION

Figure 1:
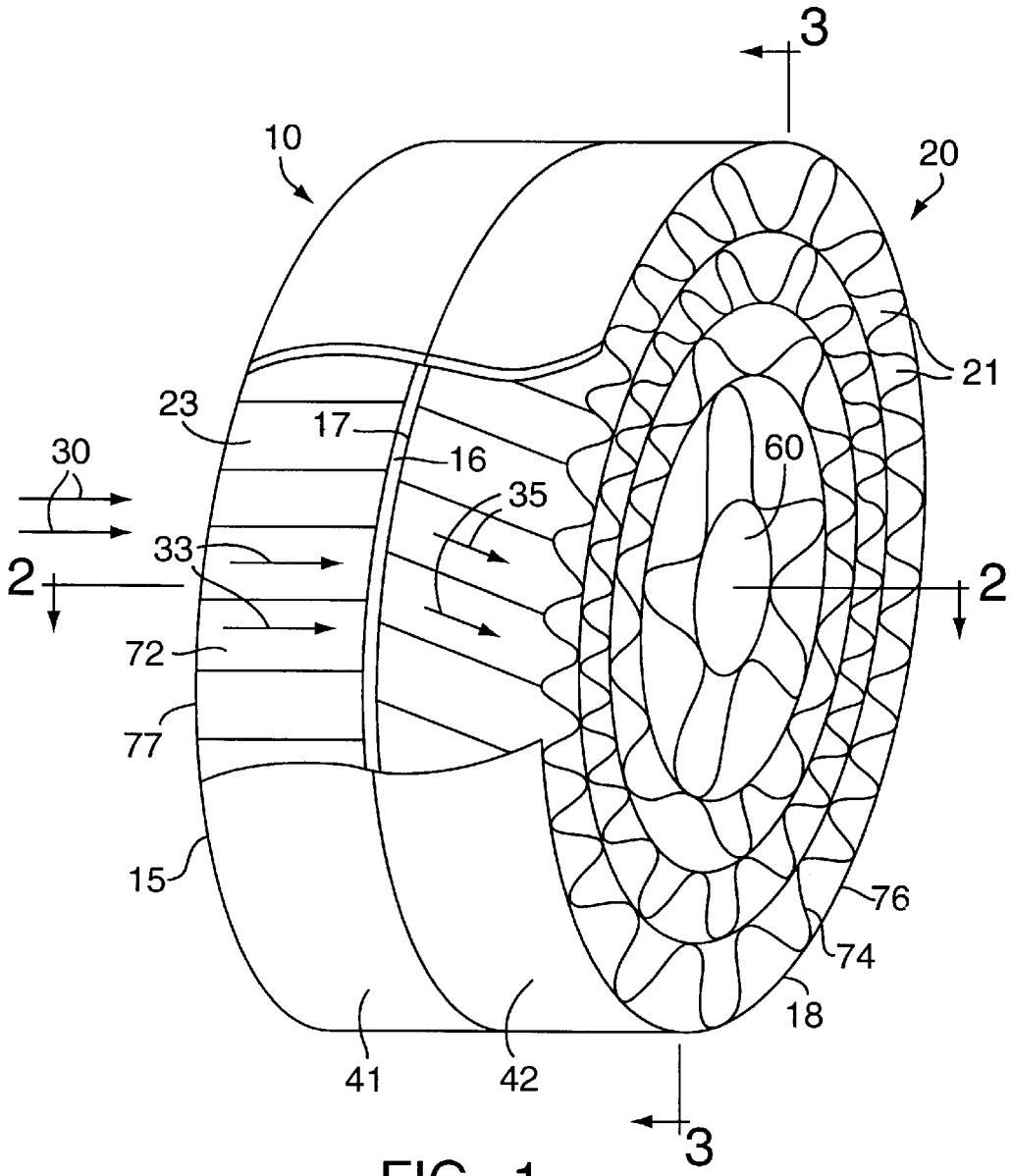
FIG. 1 is an isometric view of a swirler flashback arrestor within a non-swirling upstream monolith and an axial swirling downstream monolith.

FIG. 1 is an isometric view of a swirler flashback arrestor. The arrestor consists of a downstream monolith 20 and an upstream monolith 10. The orientations of upstream and downstream are based on normal and desired direction of fluid flow 30 through the arrestor, from the fuel source to the combustion region. The depicted fluid flow 30 is parallel, approximately perpendicular the upstream monolith face 15. The fluid enters channels 23 through upstream face 15. In this embodiment, the channels 23 in upstream monolith 10 are non-swirling; therefore a fluid traversing the channel 23 would adopt flow direction 33, which is unchanged from flow direction 30.

After exiting channels 23 through downstream face 16, the fluid enters channels 21 through upstream face 17. It is a requirement of the invention that at least one channel 21 in downstream monolith 20 have a flow path that imparts, or retains, a swirl component to the fluid that traverses the channel. In the depicted embodiment, all channels 21 impart a complimentary axial swirl so that the entire flow exiting channels through downstream face 18 adopts flow direction 35.

In this embodiment, the two monoliths, 10 and 20, are depicted as an assembly. The two outer rings, 41 and 42, of monoliths 10 and 20, respectively have been sealed together to assure all the flow exiting upstream monolith 10 enters downstream monolith 20. When the invention is placed in a fluid stream, substantially all the fluid in the stream must pass through the device. In the event bypass is permitted, the bypass region must be designed as a standalone flashback arrestor.

The invention can be made as an assembly as shown, or be made in two parts and placed into a conduit. The monoliths should be arranged so that the upstream monolith face 16 is locally parallel to the downstream monolith face 17 to minimize the gap between the channels. In this embodiment channels 21 the downstream monolith are oriented to generate a swirl to a fluid passing through the channel.

The orientation of the channels 21 allows the present invention to function both as a mixer and a flashback arrestor. A practical minimum to add a swirl component is a $\theta$ of 10 degrees. As $\theta$ increases a threshold will be achieved where the fluid exiting the downstream monolith will develop a recirculation flow pattern, the flow pattern will have vortex breakdown. If recirculation is present the arrestor will have the addition attribute of flame holding. A recirculation zone should form when $\theta$ is greater than about 45 degrees, with no hub or small diameter hub. At this condition the swirl number should be about 0.5.

It is preferred that the spatial orientation of the channels within a monolith be the same or generally the same. This, however, is not required. In most cases, the spatial orientation should at least be complimentary, tending to impart flows having a similar relative direction. As an example of the flexibility of the invention, the outer channel(s), see FIG. 4, could be oriented to not impart a swirl or even direct the flow out in an opposite direction. This might be desired in certain applications, as the flow from the outer channels could be used for film cooling, to reduce convection heat transfer to the downstream combustor chamber wall.

The channel walls, 72 and 76 of the upstream monolith channels 23 and downstream monolith channels 21, respectively are quenching. Therefore when a flashback event occurs, the walls extract heat, as thermal or chemical energy (quenching reactive chemical intermediates), from the flame front thereby extinguishing the flame. Coatings, such as catalyst, can be applied to the walls as long as the catalytic reaction does not impair the overall ability of the walls to quench a flame during a flashback event. In addition, certain materials, such as sodium, are known to enhance quenching of flame radicals more effectively than typical metal surfaces. These materials are considered negative catalysts, since they increase the flame quenching (chemical energy removal) rate.

The overall channel length of the arrestor is determined by summing the maximum individual channel length within each individual monolith element, ignoring any gap. The length of the channel is taken by measuring down the geometric center of the channel. In the present invention, the overall channel length of the arrestor will always be greater than the overall thickness of the device. The invention permits the overall channel length to be less than the single channel flashback arrestor operating under similar conditions does.

The channels 23 of the upstream monolith 10 are offset from the channels 21 of the downstream monolith 20. Offsetting of the channels assures that a flame front entering a single downstream monolith channel 21 formed by walls 74 will be split into at least two channels when the wall 77 forming upstream monolith channel 23 is encountered. The offsetting of the channels permits the overall channel length of the arrestor to be less then length required for the flame front to consume all the available fuel. Thus, the flame is extinguished with fuel remaining. The offsetting of the channels also permits the flame to be arrested in a shorter length channel than required for a single-channel monolith flashback arrestor, typical length to mean hydraulic diameter ratio of approximately 40, or greater.

The upstream monolith 10 and downstream monolith 20 as shown in FIG. 1 are contiguous with one another. A gap, however, is permissible between the various monoliths in the arrestor, but it may impair the ability to arrest flashback. If a gap is desired, the gap should be less than the shorter of the longest channel length in the upstream or downstream monolith. The length of the gap will increase the overall length of the arrestor.

Figure 2:
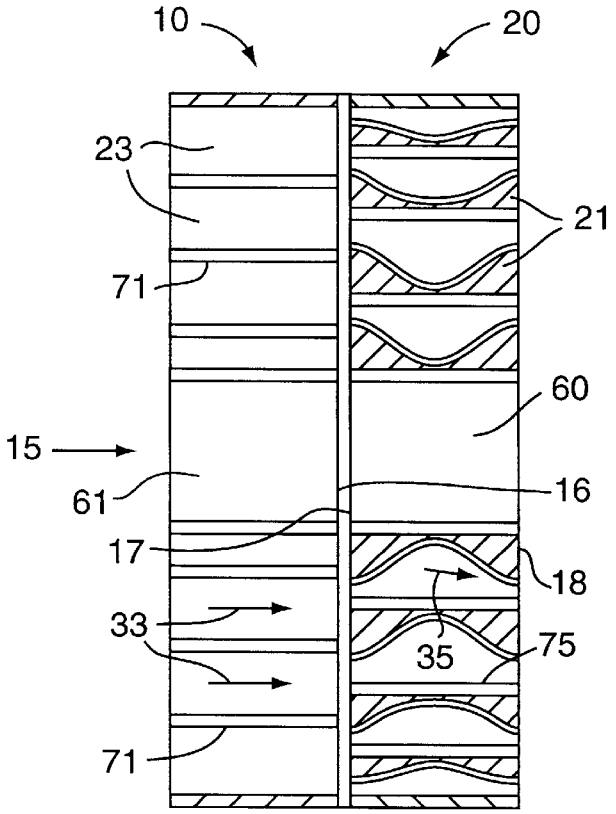
FIG. 2 is a cross-sectional view of the swirler flashback arrestor depicted in FIG. 1.

FIG. 2 is a cross-sectional view of a swirler flashback arrestor depicted in FIG. 1. The upstream monolith channels 23 are non-swirling. The downstream monolith channels 21 are oriented to impart an axial flow. As the monoliths in this configuration are made using the concentric method (discussed below) the separators 71 and 75 are perpendicular to the faces of their respective monoliths. This figure also clearly shows hubs 60 and 61 in the downstream monolith and upstream monolith, respectively. In this embodiment the hub is a void. If a void is present, the void must act as a flashback arrestor. Other hubs are possible, such as solids even other channeled configurations. The hub performs various functions, such as assisting in creating a recirculation zone, fuel injector insertion point, aid in structural strength, and positioning. As those skilled in the art will recognize the hub creates in essence a dead zone. Employing a solid hub reduces the $\theta$ required to obtain a recirculation zone. The surface area of the hub is practically limited to one-quarter the frontal area of the downstream monolith to maintain a reasonable pressure loss.

Figure 3:
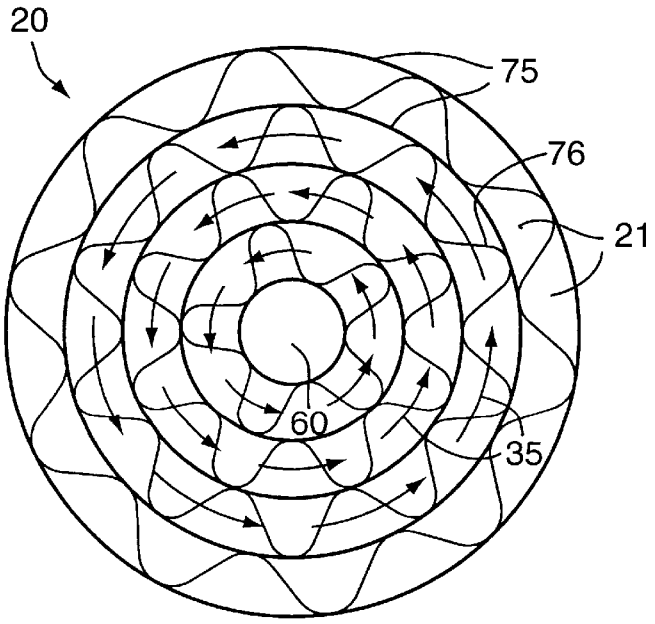
FIG. 3 is a view of the downstream face of the downstream monolith of the flashback arrestor depicted in FIG. 1 showing the resulting axial swirl pattern.

FIG. 3 is a view of downstream face 18. In this embodiment of the invention using concentric monoliths, the corrugated partition 76 and the flat partition 75 define the channels 21. The flow direction 35 depicts the flow direction for a fluid exiting the channels 21.

Figure 4:
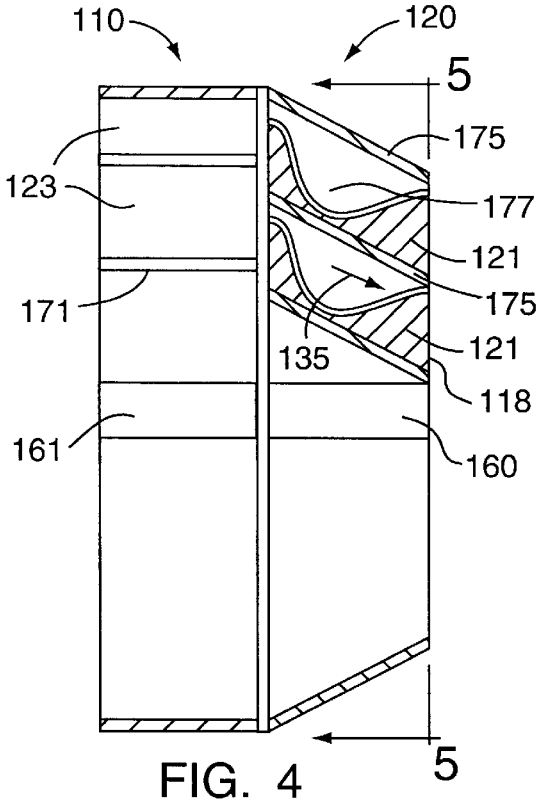
FIG. 4 is a cross-sectional view of the swirler flashback arrestor similar to that depicted in FIG. 1 but where the downstream monolith has channels that impart both a radial and axial swirl component.

FIG. 4 is a cross-sectional view of another embodiment of a swirler flashback arrestor. Like the arrestor depicted in FIG. 1 the upstream monolith 10 is axial, but in this embodiment the downstream monolith 120 has channels 121 that impart a non-planar swirl yielding flow direction 135. When an axial and a radial swirl component are added the flat partitions 175 are not perpendicular to the face of the monolith. As in the previous embodiment a hub 160 is included, which may have a geometry supportive to forming the channel geometry such as a frustum.

Figure 5:
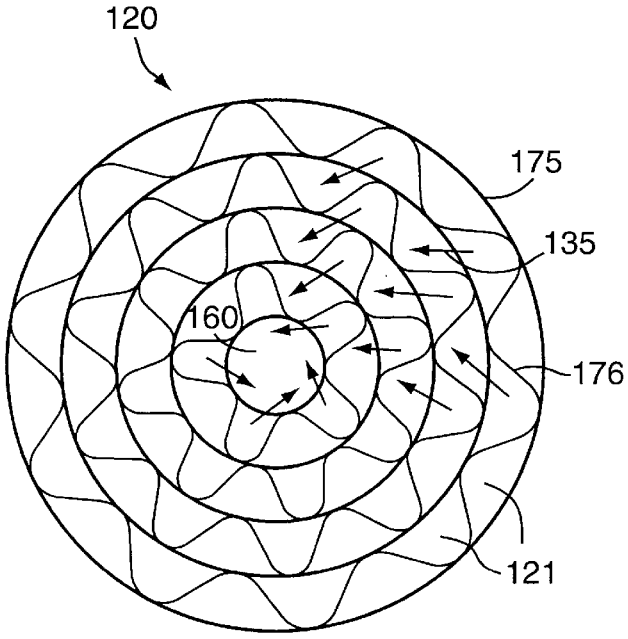
FIG. 5 is a view of the downstream face of the downstream monolith of the type depicted in FIG. 4 showing the resulting flow pattern.

FIG. 5 is a view of the downstream face 118. In this embodiment of the invention using concentric monoliths, the corrugated partition 176 and the flat partition 175 define the channels 121. The flow directions 135 depict the flow direction for a fluid exiting the channels 121. In this embodiment all channels 121 are imparting the same flow direction 35.

Figure 6:
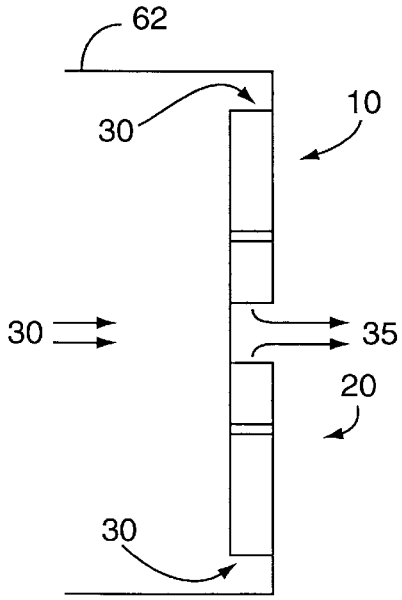
FIG. 6 is a cross-sectional view of a swirler flashback arrestor with a significant radial component.

FIG. 6 is a section view of a swirling flashback arrestor with a significant radial component. The two monoliths, 10 and 20, that make up the invention are placed within conduit 62. Note that conduit 62 is larger in mean hydraulic diameter than monolith 10, thereby allowing flow 30 to be turned nearly ninety degrees to enter the upstream monolith 10. The fluid after entering monolith 10 exits monolith 10 and then immediately enters monolith 20 and then exits downstream monolith 20 through the center of the swirling flashback arrestor adapting flow path 35.

Figure 7:
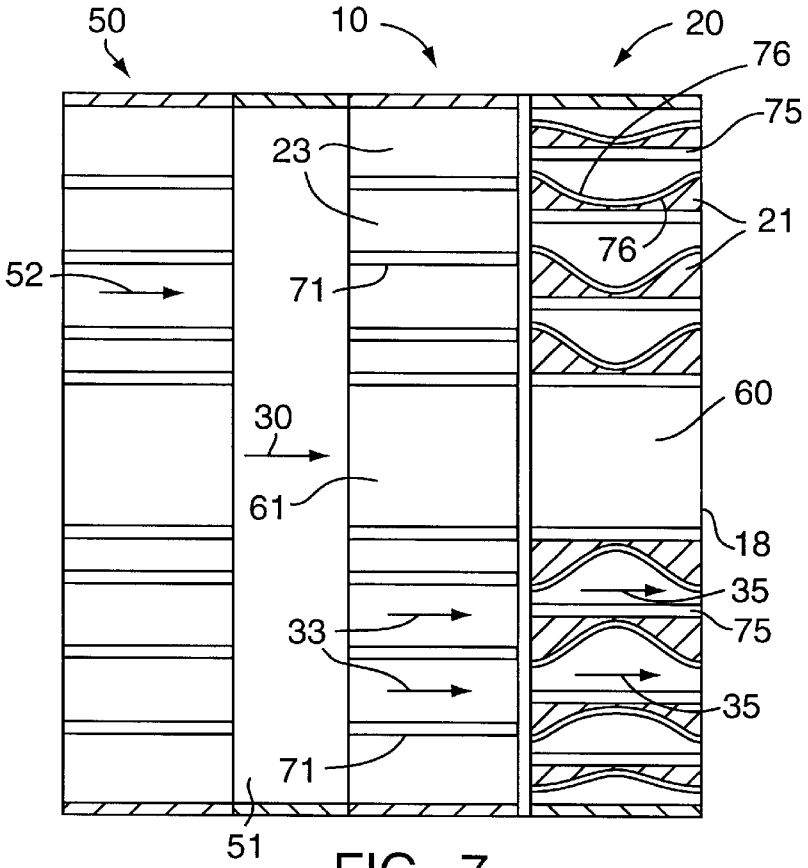
FIG. 7 is a cross-sectional view showing the swirler flashback arrestor of FIG. 1 with an upstream flow conditioner.

FIG. 7 is a cross-sectional view of a swirler flashback arrestor with an integral flow conditioner 50. The function of the arrestor can be enhanced if the flow prior to entering the arrestor is conditioned; the flow is given a more uniform flow vector. The orientation of the channels 52 of the flow conditioner as well as the channel characteristic are arbitrary, but must be complementary to the channels of the most upstream monolith 10. The flow condition 50 is placed upstream from and separated from the arrestor. A gap may exist between the flow conditioner 50 and the upstream monolith 10. The gap 51 between the flow conditioner 50 and the upstream monolith 10 is dependent upon the distance required to establish the desired degree of flow conditioning prior to the flow entering the upstream monolith 10. For example, a monolith with $1/32^{nd}$-inch diameter channels placed in contact with an upstream monolith would greatly reduce the turbulence, but it would have little affect on the downstream velocity distribution. Typically, we have found lengths of several pipe diameters were required for various flow conditions to establish highly uniform velocity distributions.

Figure 8:
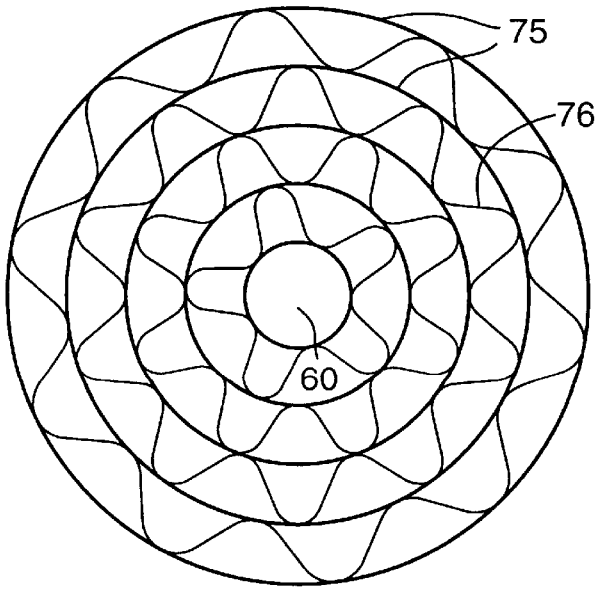
FIG. 8 depicts the concentric method of making a monolith for the present invention.
Figure 9:
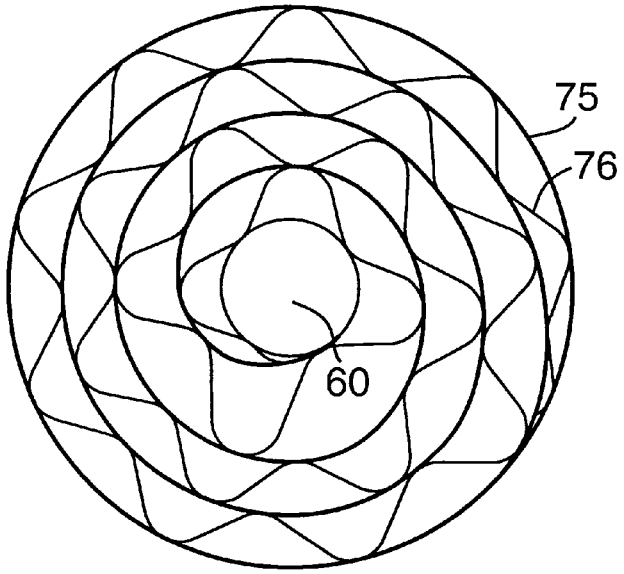
FIG. 9 depicts the spiral method of making a monolith for the present invention.
Figure 10:
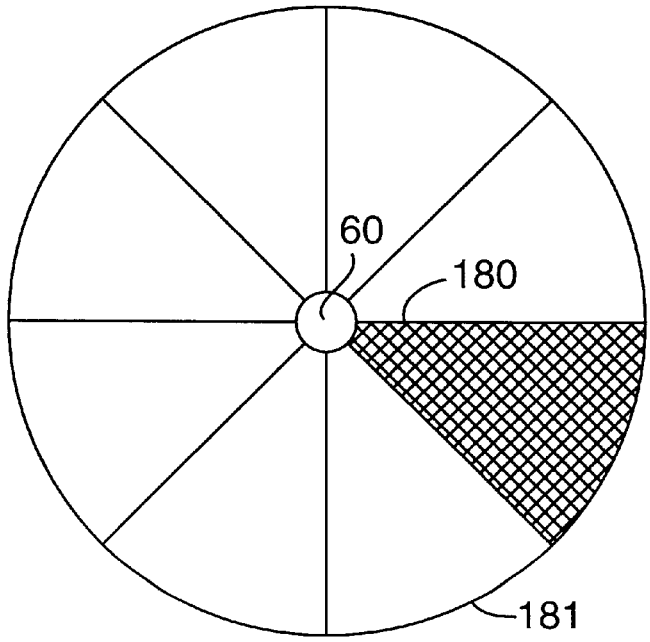
FIG. 10 depicts the sliced monolith method of making a monolith for the present invention.

FIGS. 8, 9 and 10 represent three ways to fabricate the individual monoliths of the present invention. FIGS. 8 and 9 represent an approach using corrugated metal while FIG. 10 utilizes an angled monolith structure.

FIG. 8 depicts the concentric method of constructing the present invention.

In order to make the swirling flashback arrestor, first define the following desired parameters: material thickness, mean hydraulic diameter, chord length to mean hydraulic diameter ratio ($L_c/D_h$), and vane outlet angle ($\theta$). The basic construction steps for making any concentric section are as follows. Select precut metal ribbon or shear sheet metal into ribbons of width w, such that the desired $L_c/D_h$ ratio can be achieved. The ribbon length, $L_c$, is defined as follows:

$$L_c\sqrt{(\tan(\theta)*w*0.8798)^2+(w*0.8798)^2}$$

The ribbon is then corrugated by hand feeding a ribbon into a set of spur gears (20 pitch) at an angle approximately 5 degrees less than the vane outlet angle. The cell height, from which the mean hydraulic diameter can be calculated, will be approximately equal to the gear working depth minus 3 times the material thickness. The ribbons are then twisted, in a helical fashion, enabling the corrugated ribbon to be wrapped into a circle. The degree of twisting required depends on the radius of the concentric section being made, increasing the degree of twist with decreasing radius. The ribbons are then cut to a finished length allowing for a small overlap of the two ends. The length of the ribbons will increase as the diameter of the concentric section being manufactured increases. When the ribbons are formed into a circle, the ends of the ribbon are aligned and tack welded creating a ring. A solid hub is fabricated from solid round stock of an appropriate material.

With the hub serving as a center, the rings are slipped around the hub and tack welded. The ring is tacked at each location in which the ring and hub are in contact. A dividing ring, a non-corrugated ribbon, cut at the desired vane angle at one end. Align the cut end along the center of one of the outer corrugations and with the hub face, then weld the ribbon end to the inner ring. The ribbon is then wrapped around the ring, held tightly to ensure alignment, and tack welded in a sequential fashion without skipping a corrugation. Skipping corrugations will result in an improperly sized dividing ring evident by a varying radius (waves). With 4 or 5 tack welds remaining, size and cut the dividing ring, then complete welding. Add a second weld at each juncture. Repeat this process until all desired rings are secure. The final diameter may be sized to specification by simply expanding a corrugated strip and attaching.

FIG. 9 shows the spiral configuration As in the approach above, a strip of metal is corrugated as described above. A flat metal strip is attached to the one side of the corrugated strip and then the strip wound around a common axis. A variation on this method is to make several corrugated and flat strip units, connect the units at a common point making a pinwheel and then wrap the units around a common point.

FIG. 10 is a frontal view of another method to make the present invention. In this method a long channel monolith is sliced at a desired angle. The resulting slice is then cut into a series of pie shapes such that the pies can be oriented in a circle with the channels of each pie section having approximately the same orientation to the center of the swirler flashback arrestor. The pie shapes are edged with divides 180 and all the pie shapes are wrapped with outer ring 181. This embodiment is shown with the optional hub 60.

A swirling flashback arrestor was made using the concentric method described above. The upstream monolith had non-swirling channels, $\theta$ equal to zero. The downstream monolith had channels oriented at a $\theta$ of 45 degrees clockwise. The upstream channels were hexagonal with a length of 0.086 inches and width of 0.0625 inches, mean hydraulic diameter of 0.054 inches. Mean hydraulic diameter being two times the channel cross sectional area divided by the channel wetted perimeter. The downstream monolith had triangular channels with a length of 0.195 inches and height of 0.0714 inches, mean hydraulic diameter of 0.044 inches. At ambient pressure, approximately 14.7 psia, the invention arrested flashback at 650 degrees C inlet temperature for methane and Jet-A fuels with a $\phi$ of between 0.7 and 2.0. At an inlet temperature of 600 degrees C for methane plus forty percent by volume hydrogen, flashback was arrested for mixtures having 50 feet per second inlet air velocities. The static pressure loss was less than one percent at 30 meters per second. Angling the channels of the upstream monolith to a $\theta$ of 20 degrees clockwise was found to reduce the pressure loss by approximately 15 percent. This configuration was assumed to have comparable flashback arresting capabilities.

While it is difficult to generalize the inventions specific geometric relationships for all applications considering all fuels and fuel to air ratios, the following guidelines are suggested. The minimum channel mean hydraulic diameter of the downstream monolith channels should be less than about twice the critical quenching diameter. The critical quenching diameter being the maximum diameter of a given channel geometry able to arrest the flame front for a single channel device, typically stated as a single number calculated based on experimental data for flame quenching between two parallel plates. A preferred maximum channel mean hydraulic diameter appears to be approximately 1.5 times the critical quenching diameter. The mean hydraulic diameter of the upstream monolith channels should be based on the mean hydraulic diameter of the downstream monolith channels. The channels of the upstream monolith should have a mean hydraulic diameter equal to or greater than the largest channel mean hydraulic diameter in the downstream monolith, but no greater than about four times.

The length to mean hydraulic diameter ratio of the upstream and downstream channels should be at least about one-half, but no greater than about ten. A more practical upper limit appears to be eight, to minimize pressure loss. Channel length to mean hydraulic diameter ratios of between about one to three appear optimum when skin drag is critical in the application to minimize pressure loss. In one tested embodiment, the length to mean hydraulic diameter ratio was one and one-half for the upstream non-swirling monolith and two and one-half for the 45 degree downstream swirling monolith. The minimum length to mean hydraulic diameter ratio should be less based on one non-swirling embodiment with the upstream monolith length to mean hydraulic diameter ratio of one and the downstream monolith length to mean hydraulic diameter ratio of about one and one-half.

What is claimed is:

1. The method of using a swirling flashback arrestor, said method comprising:

placing a first monolith upstream of a second monolith in a combustible fluid flow, and a first monolith comprised of a plurality of first channels extending there through defined by walls, the first channel walls having quenching surfaces, each first channel having an entrance, an exit, a length, and a mean hydraulic diameter, the first channel entrances defining an upstream face, the first channel exits defining a downstream face; and a second monolith comprised of a plurality of second channels defined by walls, the second channel walls having quenching surfaces, each second channel having a length, and a mean hydraulic diameter, the second channel entrances defining an upstream face, the second channel exits defining a downstream face, said first monolith being spatially located upstream of said second monolith with a gap between said first and said second monolith having a length less than the flame reformation distance, wherein the first channel length plus the second channel length is less than a single channel length of a single channel flashback arrestor, the first channel mean hydraulic diameter and the second channel mean hydraulic diameter are in a ratio such that a flame during a flashback event is quenched, the first monolith channels and the second monolith channels are offset, and at least one of the channels of the second monolith has a spatial orientation whereby a swirl is imparted to a fluid traversing there through, and passing a combustible fluid through both monoliths.

2. A swirler with an integral flashback arrestor comprising:

a first monolith comprised of a plurality of first channels extending there through defined by walls, the first channel walls having quenching surfaces, each first channel having an entrance, an exit, a length, and a mean hydraulic diameter, the first channel entrances defining an upstream face, the first channel exits defining a downstream face; and a second monolith comprised of a plurality of second channels defined by walls, the second channel walls having quenching surfaces, each second channel having a length, and a mean hydraulic diameter, the second channel entrances defining an upstream face, the second channel exits defining a downstream face, said first monolith being spatially located upstream of said second monolith with a gap between said first and said second monolith having a length less than the flame reformation distance, wherein the first channel length plus the second channel length is less than a single channel length of a single channel flashback arrestor, the first channel mean hydraulic diameter and the second channel mean hydraulic diameter are in a ratio such that a flame during a flashback event is quenched, the first monolith channels and the second monolith channels are offset, and at least one of the channels of the second monolith has a spatial orientation whereby a swirl is imparted to a fluid traversing there through.

3. The assembly of claim 1 further comprising means for connecting the first monolith downstream face to the second monolith upstream face such that essentially all a fluid exiting the first monolith downstream face enters the second monolith through the second monolith upstream face.

4. The assembly of claim 1 wherein said first monolith includes channels substantially all of which have a mean hydraulic diameter less than three times a critical quenching diameter and said second monolith includes channels substantially all of which have a mean hydraulic diameter less than four times the largest mean hydraulic diameter of said first monolith.

5. The assembly of claim 2 wherein the first monolith channels mean hydraulic diameters and the second monolith channels mean hydraulic diameters are greater than a critical quenching diameter.

6. The assembly of claim 5 wherein the first monolith channels mean hydraulic diameters are greater than the second monolith channels mean hydraulic diameters.

7. The assembly of claim 5 wherein the second channels are arranged concentrically about a common center.

8. The assembly of claim 5 wherein a majority of the first channel mean hydraulic diameters are less than approximately two times the critical quenching diameter.

9. The assembly of claim 8 wherein a majority of the first channels have a first channel length to first channel mean hydraulic diameter ratio less than approximately eight.

10. The assembly of claim 8 wherein the second channels have a second channel mean hydraulic diameter less than approximately two times the critical quenching diameter and the first channel length to first channel mean hydraulic diameter ratio less than approximately 8.0.

11. The assembly of claim 8 wherein the first channels generate a swirl with a swirl number less than approximately 0.1.

12. The assembly of claim 8 wherein the flow path is altered to produce a swirl number greater than approximately 0.1.

13. The assembly of claim 12 where in the flow path is altered to produce a swirl number greater than approximately 0.4 and less than approximately 0.7.

14. The assembly of claim 13 further comprising a third monolith comprised of a plurality of first channels extending there through defined by walls, each first channel having an entrance, an exit, the third monolith spatially located upstream of the first monolith upstream face, said third monolith separated from said first monolith by a gap, wherein the gap is less than the shortest channel length in said first monolith or said second monolith.

* * * * *

UNITED STATES PATENT AND TRADEMARK OFFICE

CERTIFICATE OF CORRECTION

PATENT NO. : 6,179,608 B1
DATED : January 30, 2001
INVENTOR(S) : Gilbert O. Kraemer et al.

It is certified that error appears in the above-identified patent and that said Letters Patent is hereby corrected as shown below:

Column 1,
Line 2, before BACKGROUND OF THE INVENTION, please insert:

-- GOVERNMENT RIGHTS

This invention was made with U.S. government support under NASA Contract Number NAS3-97-013. The U.S. government has certain rights in this invention. --

Signed and Sealed this

Thirteenth Day of January, 2004

JON W. DUDAS
*Acting Director of the United States Patent and Trademark Office*